US009233406B2

(12) United States Patent
Froböse et al.

(10) Patent No.: US 9,233,406 B2
(45) Date of Patent: Jan. 12, 2016

(54) WINDING DEVICE, ROLLER SYSTEM HAVING A WINDING DEVICE AND RELATED METHOD

(75) Inventors: Thomas Froböse, Versmold (DE); Udo Rauffmann, Werther (DE)

(73) Assignee: Sandvik Materials Technology Deutschland GMBH, Düsseldorf (DE)

( * ) Notice: Subject to any disclaimer, the term of this patent is extended or adjusted under 35 U.S.C. 154(b) by 944 days.

(21) Appl. No.: 13/499,981

(22) PCT Filed: Sep. 24, 2010

(86) PCT No.: PCT/EP2010/064111

§ 371 (c)(1),
(2), (4) Date: Jun. 25, 2012

(87) PCT Pub. No.: WO2011/045165

PCT Pub. Date: Apr. 21, 2011

(65) Prior Publication Data

US 2012/0272706 A1 Nov. 1, 2012

(30) Foreign Application Priority Data

Oct. 13, 2009 (DE) ..... 10 2009 045 640

(51) Int. Cl.
*B21C 47/04* (2006.01)
*B21B 23/00* (2006.01)
*B21B 15/00* (2006.01)

(52) U.S. Cl.
CPC ..... *B21C 47/04* (2013.01); *B21B 23/00* (2013.01); *B21B 2015/0057* (2013.01)

(58) Field of Classification Search
CPC ..... B21C 47/04; B21D 7/04; B21D 7/12; B21D 11/0694; B21D 11/1284; B21B 37/78; B21B 2015/0057; B21B 1/46; B21B 1/463; B21B 21/00; B21B 21/005; B21B 21/04; B21B 21/045
USPC ..... 72/206, 64, 65, 167, 175, 214, 208; 29/527.7
See application file for complete search history.

(56) References Cited

U.S. PATENT DOCUMENTS 3,858,829 A * 1/1975 Bradt et al. ..... 242/337
5,351,515 A * 10/1994 Astley ..... B21B 21/045 72/126

(Continued)

FOREIGN PATENT DOCUMENTS

DE 128 573 11/1977
DE 31 46 284 5/1983

(Continued)

OTHER PUBLICATIONS

International Search Report for PCT/EP2010/06411 dated Dec. 28, 2010.

(Continued)

*Primary Examiner* — Shelley Self
*Assistant Examiner* — Gregory Swiatocha
(74) *Attorney, Agent, or Firm* — Morgan, Lewis & Bockius LLP

(57) ABSTRACT

Winding device with which a tube produced in a rolling installation can be wound up outside the rolling installation. The tube which has already left the rolling installation is coiled or wound up in such a winding device for transport purposes. The disclosed device and method make it possible for the tube in the finished shaped condition to be put into a transportable state downstream of the roll stand while still other portions of the tube are at the stage of the tube shell or are just being shaped. For that purpose a winding device for a tube produced in a rolling installation has a bending device for curving the tube so that it can be wound in a spiral shape around a first axis, and a holding frame, wherein the bending device is mounted to the holding frame pivotably about a second axis substantially perpendicular to the first axis.

11 Claims, 2 Drawing Sheets

(56) References Cited

U.S. PATENT DOCUMENTS

Figure 1:
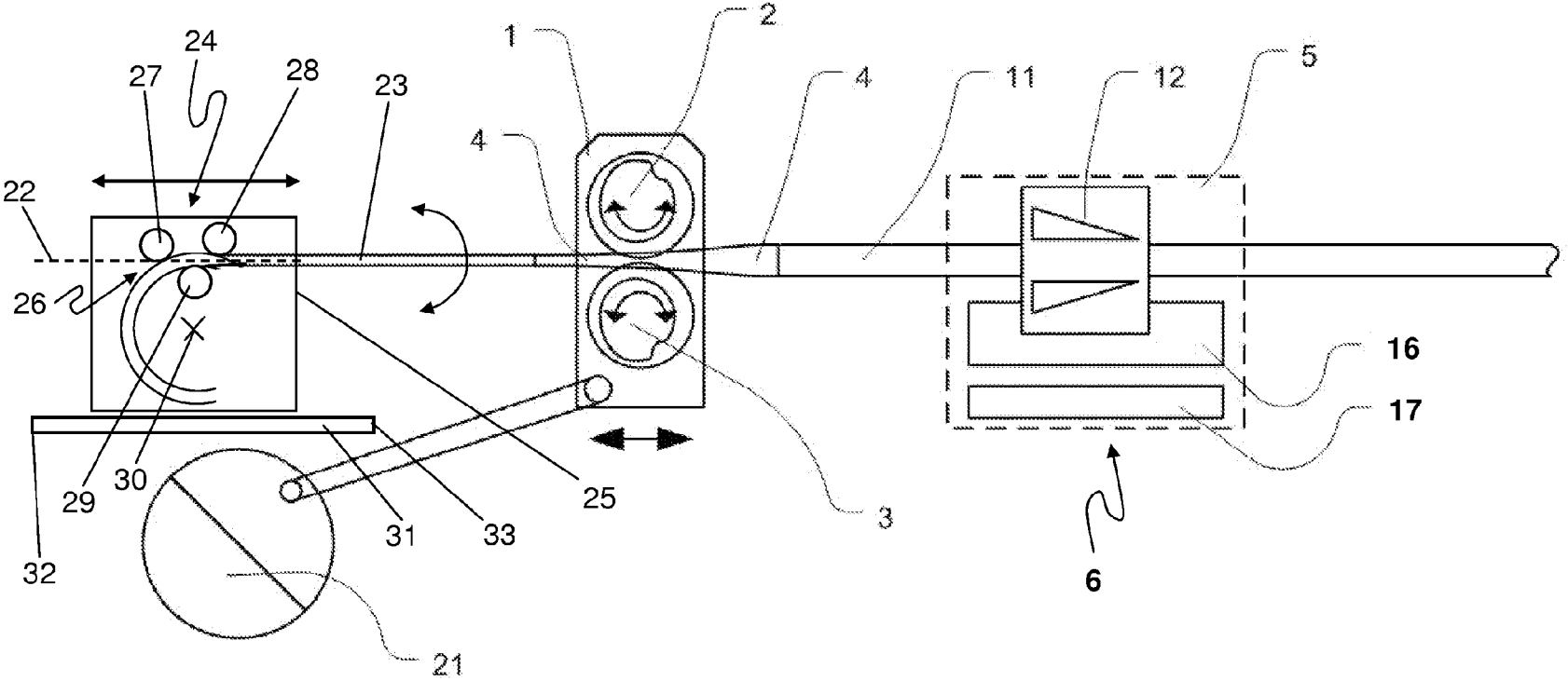

| | | | | |
|---|---|---|---|---|
| 5,606,885 | A * | 3/1997 | Baensch | B21B 21/005 72/214 |
| 6,305,068 | B1 * | 10/2001 | Sroka | B22D 11/1284 164/413 |
| 2005/0126245 | A1 * | 6/2005 | Saegusa | B21D 7/024 72/149 |
| 2010/0116012 | A1 * | 5/2010 | Hermes | B21D 7/08 72/166 |

FOREIGN PATENT DOCUMENTS

| | | |
|---|---|---|
| DE | 44 19 827 | 12/1994 |
| JP | 59-206117 | 11/1984 |
| SU | 751459 | 7/1980 |

OTHER PUBLICATIONS

German Search Report for DE 10 2009 045 640.6 dated Jun. 23, 2010.

* cited by examiner

WINDING DEVICE, ROLLER SYSTEM HAVING A WINDING DEVICE AND RELATED METHOD

RELATED APPLICATIONS

The present application is a U.S. National Phase Application of International Application No. PCT/EP2010/064111 (filed 24 Sep. 2010) which claims priority to German Application No. 10 2009 045 640.6 (filed 13 Oct. 2009).

The present invention concerns a winding device for a tube produced in a rolling installation as well as a rolling installation having such a winding device and a method of winding a finished tube.

For the manufacture of precise metal tubes, in particular of steel, an expanded hollow-cylindrical blank is cold reduced generally in the completely cold condition by pressure stresses. In that case the blank is converted to the form of a tube of defined reduced outside diameter and defined wall thickness.

The most wide-spread reducing method for tubes is known as cold pilgering, the blank being referred to as the tube shell. In the rolling operation the tube shell is pushed over a rolling mandrel which is calibrated, that is to say which is of the inside diameter of the finished tube, and in that situation is embraced from the outside by two rolls which are calibrated, that is to say which define the outside diameter of the finished tube, and are rolled out in the longitudinal direction over the rolling mandrel.

During cold pilgering the tube shell experiences a stepwise feed in a direction towards the rolling mandrel or beyond same while the rolls are horizontally reciprocated rotatingly over the mandrel and thus the tube shell. In that case the horizontal movement of the rolls is predetermined by a roll stand to which the rolls are rotatably mounted. In known cold pilger rolling mills the roll stand is reciprocated by means of a crank drive in a direction parallel to the rolling mandrel while the rolls themselves receive their rotary movement from a rack which is stationary relative to the roll stand and into which engage gears which are fixedly connected to the roll shafts.

The feed of the tube shell over the mandrel is effected by means of a feed clamping saddle which permits a translatory movement in a direction parallel to the axis of the rolling mandrel.

The conically calibrated rolls arranged in mutually superposed relationship in the roll stand rotate in opposite relationship to the feed direction of the feed clamping saddle. The so-called pilger mouth formed by the rolls engages the tube shell and the rolls push a small wave of material away from the outside, the wave being stretched out by the smoothing caliber of the rolls and the rolling mandrel to afford the intended wall thickness until the clearance caliber of the rolls releases the finished tube. During the rolling operation the roll stand with the rolls mounted thereto moves in opposite relationship to the feed direction of the tube shell. After reaching the clearance caliber of the rolls the tube shell is fed by means of the feed clamping saddle by a further step towards the rolling mandrel while the rolls with the roll stand move back into their horizontal starting position. At the same time the tube shell experiences a rotation about its axis to achieve a uniform shape for the finished tube. Rolling over each tube portion a plurality of times provides a uniform wall thickness and roundness for the tube and uniform inside and outside diameters.

Because of the complex movements performed by the tube shell or the finished tube which consist of a superimpositioning of rotational and translatory movements the finished tube in the state of the art must have first completely left the rolling installation before it can be put into a transportable condition, for example by being wound up.

In comparison with that state of the art the object of the present invention is to provide a device and a method which make it possible for the tube in the finished transformed condition to be put into a transportable condition downstream of the roll stand while other portions of the tube are still at the stage of the tube shell or are just being changed in shape.

That object is attained by a winding device for a tube produced in a rolling installation, comprising a bending device for curving the tube so that it can be wound in a spiral shape around a first axis, and a holding frame, wherein the bending device is mounted to the holding frame pivotably about a second axis substantially perpendicular to the first axis.

Such a device makes it possible for the tube which is in the finished shaped condition and which is issuing from the rolling installation to be received and so curved that it can be wound up on a spiral path. That arrangement permits a considerable saving in time in the production of steel tubes which are of such dimensions that they can be wound up as the tube issuing from the roll stand can already be wound up while in the same line a tube shell can still be introduced into the pilger mouth and shaped there. In addition the device according to the invention permits a considerable space saving for the rolling installation as such as, in production of the tube, it is not necessary for the entire line of tube to firstly come out of the roll stand over its entire length before it can be coiled or wound up.

The core of the winding device according to the invention is that the bending device is mounted pivotably about an axis. In that way the bending device can follow the pivotal movement which the tube or the tube shell perform driven by the feed clamping saddle in the rolling operation and the tube can be wound up without twisting distortion. Without a corresponding pivotable mounting for the bending device, the tube would suffer from twisting distortion when being wound up and that would entail considerable losses of quality in the finished tube.

In an embodiment the second axis about which the bending device is mounted pivotably to the holding frame is parallel to the axis of symmetry of the finished tube issuing from the roll stand and preferably the second pivot axis coincides with the axis of symmetry of the finished tube issuing from the roll stand.

In an embodiment of the invention the bending device is pivotable by motor drive about the second axis. Admittedly in principle the pivotal movement of the bending device can also be afforded by the pivotal movement of the finished tube issuing from the roll stand, but a motor drive substantially prevents the tube suffering from torsional stresses upon being wound up.

In an embodiment of the invention the bending device has at least three rollers rotatable about a respective axis of rotation, wherein the axes of rotation are arranged substantially parallel to the first axis and wherein at least two of the axes of rotation are at a mutually different spacing from the first axis so that in operation of the device the tube is guided between two rollers on a first side and a roller on a second side.

That arrangement of the rollers of the bending device permits continuous curvature of the tube and thus permits it to be wound up around the first axis. In a preferred embodiment two rollers are at a greater spacing from the first axis than the third roller arranged between them. The radius of curvature which the bending device imparts to the finished tube then depends on the difference in the spacings of the first and second rollers respectively and the third roller from the first axis.

In that respect in an embodiment of the invention when the beginning of the tube to be curved is threaded into the winding device the difference in the spacings from the first axis must first be so adjusted that the tube can pass freely between the rollers while it is only then that the difference in the spacings of the rollers from the first axis is so adjusted that the roller which is closer to the first axis causes the tube to be curved.

In an embodiment of the invention at least one of the rollers is rotatable in motor-driven fashion. While in principle it can also be envisaged that bending and subsequent winding of the tube is driven by the movement of the feed clamping saddle of the rolling installation, a motor drive for at least one of the rollers of the bending device prevents the tube experiencing compressive or tensile stresses in the longitudinal direction during the winding operation.

In a preferred embodiment the holding frame is so designed that it is movable in a direction substantially parallel to the second axis. In that way the winding device or its bending device can follow the translatory movement of the tube in the longitudinal direction thereof in the rolling operation and the winding operation is effected substantially free from the influences of the forces of the feed movement in the rolling operation.

In that respect a possible embodiment is one in which the holding frame is movable in motor-driven fashion.

The aforementioned object is also attained by a rolling installation having an embodiment of the winding device as was described hereinbefore.

In an embodiment of the invention the rolling installation is a cold pilger rolling installation having two rolls, wherein the winding device is arranged in the feed direction of the tube downstream of the rolls or the roll stand to which the rolls are mounted.

In an embodiment of the invention the rolling installation has two rollers and at least one feed clamping saddle, wherein the feed clamping saddle in operation of the rolling installation accommodates a tube shell and pushes it between the rolls, wherein the feed clamping saddle is adapted to be pivotable and receives the tube shell pivotably about its longitudinal axis, and the rolling device has a control means which is so adapted that in operation of the device it synchronously pivots the feed clamping saddle and the bending device. In such an embodiment the bending device is mounted to the holding frame pivotably by motor means about the second axis. That 'electronic shaft' between the feed clamping saddle and the winding device permits the finished tube to be wound up in almost torsional distortion-free fashion in the longitudinal direction.

In an embodiment the rolling installation has a control means which is so adapted that in operation of the device in a first phase it drives at least one of the rollers of the bending device in such a way that they pull the holding frame with the bending device on the tube in opposite relationship to the feed direction of the tube and which in a second phase fixes at least one roller of the bending device in such a way that the holding frame with the bending device is movable by the tube in the feed direction of the tube. In that way operation of the rolling installation according to the invention can be ensured with the winding device in which the winding device is pulled in opposite relationship to the feed direction along the tube in the direction of the rollers and in so doing winds up the tube. When the reversal point, that is to say the end point in regard to guidance of the translatory movement of the holding frame, is reached, the winding procedure is interrupted and at least one of the rollers fixes the bending device to the tube to be wound up. Driven by the feed movement of the tube the holding frame is then displaced in the feed direction to the other end point of its translatory movement and the winding activity of the winding device begins afresh.

The aforementioned object is also attained by a method of winding a tube finished in a rolling installation, which comprises the steps: curving the tube in a bending device so that it can be wound in a spiral shape around a first axis, and pivoting the bending device about a second axis substantially perpendicular to the first axis.

In an embodiment such a method is used for the production of a wound-up tube which in addition comprises the steps: feeding a tube shell in a rolling installation, and shaping the tube shell to a finished tube.

In that respect in an embodiment the tube shell is shaped by rolling, wherein the tube shell is pivoted about its longitudinal axis in the shaping operation, wherein pivotal movement of the tube shell and pivotal movement of the bending device are effected synchronously.

In an embodiment of the method the bending device has rollers which come into engagement with the tube, wherein in a first phase at least one of the rollers is driven in such a way that they pull the bending device on the tube in opposite relationship to the feed direction of the tube and wherein in a second phase at least one roller is fixed in such a way that the bending device is moved by the tube in the feed direction of the tube.

Further advantages, features and possible uses of the present invention will be apparent from the description hereinafter of a preferred embodiment and the related Figures.

Figure 2:
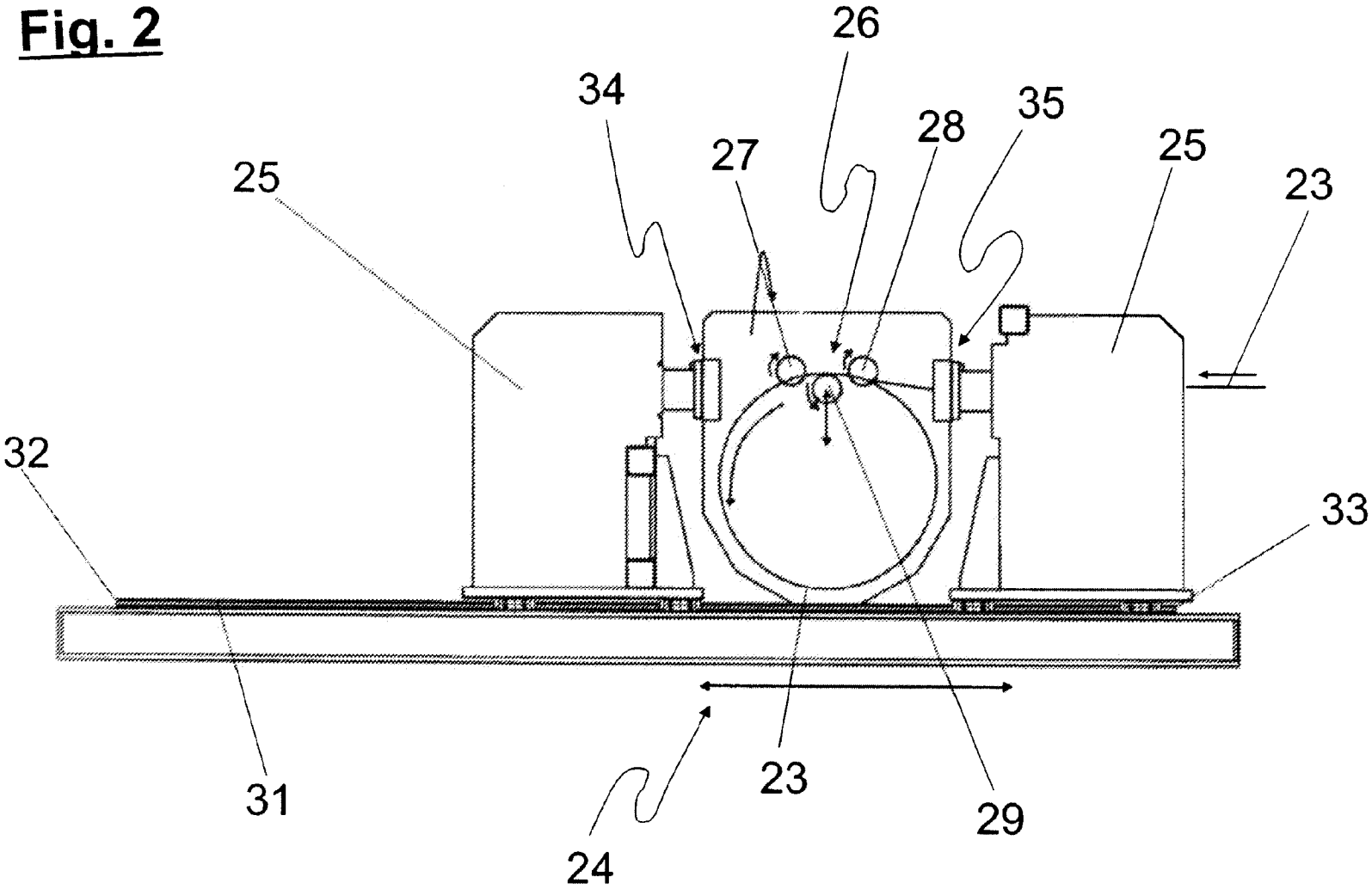

FIG. 1 shows a side view illustrating the diagrammatic structure of a cold pilger rolling installation with a winding device according to an embodiment of the present invention, and FIG. 2 shows a detailed side view of the winding device according to the invention of FIG. 1.

FIG. 1 is a diagrammatic side view showing the structure of a cold pilger rolling installation according to the invention. The rolling installation comprises a roll stand 1 having rolls 2, 3, a calibrated rolling mandrel 4 and a feed clamping saddle 5. In the illustrated embodiment the cold pilger rolling installation has a linear motor 6 as a direct drive for the feed clamping saddle 5. The linear motor is made up of a rotor 16 and a stator 17.

During the cold pilger rolling operation on the installation shown in FIG. 1 the tube shell 11 experiences a stepwise feed in a direction towards and beyond the rolling mandrel 4 while the rolls 2, 3 are horizontally reciprocated rotatingly over the mandrel 4 and thus over the tube shell 11. In that case the horizontal movement of the rolls 2, 3 is predetermined by a roll stand 1 to which the rolls 2, 3 are rotatably mounted. The roll stand 1 is reciprocated by means of a crank drive 21 in a direction parallel to the rolling mandrel 4 while the rolls 2, 3 themselves receive their rotary movement by virtue of a rack (not shown) which is stationary relative to the roll stand 1 and into which engage gears fixedly connected to the roll shafts. The feed for the tube shell 11 over the mandrel 4 is effected by means of the feed clamping saddle 5 which permits a translatory movement in a direction parallel to the axis of the rolling mandrel. The conically calibrated rolls 2, 3 arranged one above the other in the roll stand 1 rotate in opposite relationship to the feed direction of the feed clamping saddle 5. The so-called pilger mouth formed by the rolls engages the tube shell 11 and the rolls 2, 3 press a small wave of material away from the outside, the wave being stretched out by a smoothing caliber of the rolls 2, 3 and the rolling mandrel 4 to give the intended wall thickness until a clearance caliber of the rolls 2, 3 releases the finished tube. During the rolling procedure the roll stand 1 with the rolls 2, 3 mounted thereto moves in opposite relationship to the feed direction of the tube shell 11. After reaching the clearance caliber of the rolls 2, 3, the tube shell 11 is advanced by means of the feed clamping saddle 5 by a further step towards the rolling mandrel 4 while the rolls 2, 3 return with the roll stand 1 to their horizontal starting position. At the same time the tube shell 11 experiences a rotation about its axis 22 to achieve a uniform shape for the finished tube. A uniform wall thickness and roundness for the tube and uniform inside and outside diameters are achieved by rolling over each tube portion a plurality of times.

A winding device 24 is provided to be able to wind the finished tube 23 up into a transportable form downstream of the roll stand 1. The winding device 24 which is diagrammatically shown in FIG. 1 comprises a holding frame 25 and a bending device 26.

The bending device 26 has three rollers 27, 28, 29 which in the illustrated embodiment are all three driven by motor means and come into frictional engagement with the finished tube 23. The three rollers 27, 28, 29 bend the finished tube 23 about a notional axis 30. The axis 30 is substantially perpendicular to the axis of symmetry 22 of the finished tube 23 as it leaves the rolls 2, 3. While the pair of rollers 27, 28 is arranged over the finished tube 23 the third roller 29 is arranged under the finished tube 23 and provides that the finished tube 23 is curved in the bending device 26. In that case the bending radius of the tube 23 depends on the difference in the spacings of the roller 29 from the axis 30 and the pair of rollers 27, 28 from the axis 30.

The bending device 26 or the three rollers 27, 28, 29 are fixed to the holding frame 25 pivotably about the axis 22. In that case the pivotal movement of the rollers 27, 28, 29 about the axis 22 is effected by means of a motor drive.

In the illustrated embodiment the pivotal movement of the bending device 26 with the rollers 27, 28, 29 is synchronised by way of a control means with the pivotal movement of the tube shell, that is imposed on the tube shell by the feed clamping saddle 5. Thus the finished tube 23 can be wound up without torsional stresses during the rolling operation.

In addition the holding frame 25 is mounted on a rail 31 in such a way that it can perform a translatory movement in and in opposite relationship to the feed direction of the tube shell 11 or the tube 23. The translatory movement of the holding frame 25 is effected not by way of a separate motor drive but is produced in the one direction by the feed of the tube shell 11 or the finished tube 23 and in the other direction by a motor-driven rotary movement of the rollers 27, 28, 29.

When the holding frame 25 is disposed against the abutment 32 of the rail 31, that faces away from the roll stand 1, the winding operation begins, while the tube shell 11 or the finished tube 23 is still in the condition of being fed. For that purpose the rollers 27, 28, 29 are so driven that they pull the holding frame 25 on the finished tube 23 in the direction of the roll stand 1 and in so doing curve and wind up the finished tube 23. When the abutment 33 on the rail 31, that is towards the roll stand 1, is reached, the rotary movement of the rollers 27, 28, 29 is stopped and they fix the finished tube 23 relative to the holding frame 25. The holding frame 25 now begins to move again in the feed direction, driven by the feed of the finished tube 23, in the direction of the first abutment 32. When the abutment 32 is reached a winding-up phase begins again.

FIG. 2 shows the winding device 24 of FIG. 1 in detail. In this case identical components are denoted by identical references. It is possible to clearly see the mounting of the holding frame 25 on a rail 31 which permits a translatory movement parallel with and in opposite relationship to the feed direction. The holding frame 25 has two bearings 34, 35 for receiving a pivot shaft for the bending device 26. It is also possible to clearly see the three bending rollers 27, 28, 29 which, being motor-driven, form the bending device 26.

For the purposes of the original disclosure it is pointed out that all features as can be seen by a man skilled in the art from the present description, the drawings and the claims, even if they have been described in specific terms only in connection with certain other features, can be combined both individually and also in any combinations with others of the features or groups of features disclosed herein insofar as that has not been expressly excluded or technical aspects make such considerations impossible or meaningless. A comprehensive explicit representation of all conceivable combinations of features is dispensed with here only for the sake of brevity and readability of the description. While the invention has been illustrated and described in detail in the drawings and the preceding description that illustration and description is only by way of example and is not deemed to be a limitation on the scope of protection as defined by the claims. The invention is not limited to the disclosed embodiments.

Modifications in the disclosed embodiments are apparent to the man skilled in the art from the drawings, the description and the accompanying claims. In the claims the word 'have' does not exclude other elements or steps and the indefinite article 'a' does not exclude a plurality. The mere fact that certain features are claimed in different claims does not exclude the combination thereof. References in the claims are not deemed to be a limitation on the scope of protection.

LIST OF REFERENCES

1 roll stand
2 rolls
3 rolls
4 rolling mandrel
5 feed clamping saddle
6 linear motor
11 tube shell
16 rotor
17 stator
22 axis of symmetry and axis of rotation
23 finished tube
24 winding device
25 holding frame
26 bending device
27 bending roller
28 bending roller
29 bending roller
30 notional axis
31 rail
32,33 abutments
34,35 bearings

The invention claimed is:

1. A rolling installation comprising two rolls and at least one feed clamping saddle, wherein the feed clamping saddle in operation of the rolling installation accommodates a tube shell and pushes the tube between the rolls, wherein the feed clamping saddle is adapted to be pivotable and receives the tube shell pivotably about its longitudinal axis, wherein the rolling installation further comprises a winding device for the tube comprising a bending device for curving the tube so that it can be wound in a spiral shape around a first axis, and a holding frame, wherein the bending device is mounted to the holding frame pivotably about a second axis substantially perpendicular to the first axis wherein the holding frame is designed such that the holding frame is movable in a direction substantially parallel to the second axis, and wherein the rolling installation has a control means which is so adapted that in operation of the rolling installation, the rolling installation synchronously pivots the feed clamping saddle and the bending device.

2. A rolling installation as set forth in claim 1 wherein the bending device is pivotable by a motor drive about the second axis.

3. A rolling installation as set forth in claim 1 wherein the bending device has at least three rollers rotatable about a respective axis of rotation, wherein the axes of rotation are arranged substantially parallel to the first axis and wherein at least two of the axes of rotation are at a mutually different spacing from the first axis so that in operation of the device the tube is guided between two rollers on a first side of the tube and a roller on a second side of the tube.

4. A rolling installation as set forth in claim 3 wherein at least one of the rollers is driven by a motor.

5. A rolling installation as set forth in claim 1 wherein the holding frame is movable in motor-driven fashion.

6. A rolling installation as set forth in claim 1 wherein the rolling installation is a cold pilger rolling installation having two rolls and wherein a rolling device is arranged downstream of the rolls in a feed direction of the tube.

7. A rolling installation as set forth in claim 1 wherein the rolling installation has a control means which is so adapted that in operation of the rolling installation in a first phase it drives at least one of a set of rollers of the bending device in such a way that such rollers pull the holding frame with the bending device on the tube in opposite relationship to a feed direction of the tube and which in a second phase fixes at least one of said rollers of the bending device in such a way that the holding frame with the bending device is movable by the tube in the feed direction of the tube.

8. A rolling installation as set forth in claim 1 wherein the feed clamping saddle and the bending device have pivoting motions in the same rotational direction.

9. A method of producing a wound tube comprising the steps:

feeding a tube shell into a rolling installation, shaping the tube shell to a finished tube, and winding of the tube comprising the steps of:

curving the tube in a bending device so that it can be wound in a spiral shape around a first axis, and pivoting the bending device about a second axis substantially perpendicular to the first axis, wherein the tube shell is shaped by rolling, wherein the tube shell is pivoted about its longitudinal axis in the shaping operation, and wherein pivotal movement of the tube shell and pivotal movement of the bending device are effected synchronously.

10. A method as set forth in claim 9 wherein the bending device has rollers which come into engagement with the tube, wherein in a first phase at least one of the rollers is driven in such a way that said rollers pull the bending device on the tube in opposite relationship to a feed direction of the tube and wherein in a second phase at least one of said rollers is fixed in such a way that the bending device is moved by the tube in the feed direction of the tube.

11. A method as set forth in claim 9 wherein the pivotal movement of the feed clamping saddle and the pivotal movement of the bending device occur in the same rotational direction.

* * * * *